US006083142A

United States Patent [19]

Wilson

[11] Patent Number: 6,083,142

[45] Date of Patent: Jul. 4, 2000

[54] MOBILE, MODULAR CLIMBING TOWER

[75] Inventor: Jeffrey D. Wilson, Newcastle, Calif.

[73] Assignee: Extreme Engineering LLC, Newcastle, Calif.

[21] Appl. No.: 09/105,903

[22] Filed: Jun. 26, 1998

Related U.S. Application Data

[60] Provisional application No. 60/073,016, Jan. 29, 1998.

[51] Int. Cl.[7] ..... A63B 9/00

[52] U.S. Cl. ..... 482/37; 482/35; 482/51; 472/136; 280/DIG. 8; 52/245

[58] Field of Search ..... 482/35–37, 148; 446/476; 472/136; 52/79.4, 245, 457, 578; 250/423.1, DIG. 8

[56] References Cited

U.S. PATENT DOCUMENTS

| | | | |
|---|---|---|---|
| 4,941,548 | 7/1990 | Blanchard . | |
| 4,997,064 | 3/1991 | Motte et al. . | |
| 5,092,587 | 3/1992 | Ulner et al. . | |
| 5,125,877 | 6/1992 | Brewer . | |
| 5,254,058 | 10/1993 | Savigny . | |
| 5,256,116 | 10/1993 | Robinson . | |
| 5,543,185 | 8/1996 | Christensen . | |
| 5,593,368 | 1/1997 | Checketts . | |
| 5,732,954 | 3/1998 | Strickler et al. | 482/37 |
| 5,941,041 | 8/1999 | Robinson et al. | 482/37 |

FOREIGN PATENT DOCUMENTS

| | | | |
|---|---|---|---|
| 81/01107 | 4/1981 | WIPO | 482/35 |
| 91/08806 | 6/1991 | WIPO | 482/37 |

OTHER PUBLICATIONS

FORM, Inc., 1964 catalog, S. Lyon, MI, p. 3, 482/35.

Rubin, Diana, Scaling New Heights, The Washington Post Weekend, p. 59, May 16, 1997.

*Primary Examiner*—Richard J. Apley

*Assistant Examiner*—Victor Hwang

*Attorney, Agent, or Firm*—TownsendTownsend&Crew LLP; Mark D. Barrish, Esq.

[57] ABSTRACT

The invention provides improved climbing devices and structures for use in mobile and fixed climbing installations. The mobile climbing installation has a modular climbing tower pivotally mounted to a trailer to pivot between a road orientation and a climbing orientation. Modular climbing towers are generally assembled from panels having lateral curves by fastening upper and lower flanges of the panels together. The panels and flanges are integrally molded from fiberglass, and act as a monocoque structure. The climbing surface is on the radially outward portion of the partially or fully enclosed tower, thereby increasing the number of climbers that can safely be accommodated on a climbing surface of a given width. The invention also provides belaying devices for safely supporting a climber at the end of a flexible member such as a cable, rope, or the like. These belaying devices generally draw in the flexible member as the climber climbs. When the climber falls or completes the climbing route, the belay device supports the climber's weight, slowly and safely lowering the climber down to the ground. The exemplary auto-belay device makes use of a hydraulic piston mechanism to separate a pair of pulley assemblies. The flexible members runs back and forth between the pulley assemblies with a plurality of windings, so that the stroke of the hydraulic piston is significantly less than the height of the climbing structure.

12 Claims, 14 Drawing Sheets

MOBILE, MODULAR CLIMBING TOWER

CROSS-REFERENCE TO RELATED APPLICATIONS

This application claims the benefit of U.S. Provisional Application No. 60/073,016, filed Jan. 29, 1998, the full disclosure of which is incorporated by reference.

BACKGROUND OF THE INVENTION

1. Background of the Invention

The present invention relates generally to recreational equipment, and more specifically, provides devices and artificial structures for use in rock climbing.

Rock climbing has increased in popularity tremendously over the last few decades. Where even mountaineers once avoided the steepest rock faces, modern sport climbers seek far and wide for challenging crags. As climbing techniques and technology have improved, more and more climbers can be found on the available rock walls, and these climbers are ascending more and more difficult rock climbing routes.

With the increase in popularity of rock climbing (and the increasing difficulty of the climbs), artificial rock climbing walls have become quite popular. Such walls allow climbers to practice and hone their skills, and allow beginners to experience rock climbing in a safe environment. In addition, artificial climbing walls allow purchasers of climbing boots, harnesses, and other equipment to test these articles in a store prior to purchase. Hence, artificial climbing walls are becoming commonplace for indoor gymnasiums, resorts, climbing equipment retail stores, and the like.

A typical climbing gym will have a wall constructed of plywood with T-nuts inserted through the plywood panels to the climbing surface. The T-nuts allow structures called climbing holds to be affixed on the climbing surface. These climbing holds are often threadably fastened to the T-nuts so that the holds can be added, removed, or changed to vary the features and difficulty of ascending the artificial wall. The climbing holds are typically made of resin-concrete, and can be shaped as desired. For example, an easy hold would provide a large external ledge, which is easily grabbed or stepped on. A more difficult hold will only extend slightly from the climbing surface, making it more difficult for the climber to support their weight. The paths climbers take up a climbing wall along the holds is generally referred to as a climbing route.

More recent advancements in climbing wall structures have enhanced the look and feel of the climbing surface. Initially, the flat plywood panels were often covered with a mixture of sand and paint to more nearly approximate the texture of natural rock. Textured fiberglass panels having molded features that more nearly approximate those of natural walls are also now available. The molded panels often incorporate T-nuts or other hold attachment structures so that the difficulty of the various routes can be changed after the panels are assembled. Alternative artificial rock climbing structures make use of polystyrene foam blocks that are attached to support structures and then cut to irregular rocklike shapes. The shaped polystyrene foam can then be covered with a hard coating for climbing. Hence, advancements in artificial climbing structures for use in a fixed location such as a climbing gym, climbing equipment store, and the like, have gradually enhanced these practice climbing facilities by providing more realistic walls that closely approximate natural rock formations.

As climbing has further increased in popularity, attempts have been made to provide portable climbing structures that can be set up for temporary use at fairs or other events. Not surprisingly, the mobile climbing structures proposed to date often make use of the climbing wall construction techniques that were developed for fixed installations. Although these mobile climbing structures have been fairly successful, work in connection with the present invention has shown that fixed wall structures have certain limitations that limit their usefulness when they are mounted to a tilt-up trailer or supported by a collapsible scaffolding. In particular, tilt-up trailers having known climbing wall structures generally do not accommodate as many climbers as would be desirable, due in-part to the limitations on the size of a trailer vehicle. While it is possible to construct more complex articulated climbing wall structures that can unfold at an event site, the cost and complexity of the unfolding mechanism more than outweighs the increase in the number of climbers the articulated structures can handle. Additionally, these known portable rock climbing structures generally make use of a simple pulley arrangement to support the climbers, so that the safety of the climber depends on the skill of a "belayer," an assistant required for each climber to tend the rope as the climber ascends. Although this arrangement works well for pairs of skilled climbers, it may be inconvenient, expensive, or even dangerous to rely on a belayer for the safety of each climber at a public event such as a fair or the like.

In light of the above, it would be desirable to provide improved artificial rock climbing structures and devices. It would be particularly desirable to provide climbing structures that were better suited for use in a mobile climbing system, particularly if these improved structures also had potentially advantageous applications for fixed climbing installations. It would further be desirable to provide improved climber safety devices for use with artificial climbing structures, both mobile and fixed. It would be best if these improvements enhanced the number of climbers that can be accommodated, but without significantly increasing the cost or complexity of the climbing experience.

2. Description of the Background Art

The following patents may be relevant to the present invention, and the full disclosures of each is incorporated herein by reference: U.S. Pat. Nos. 4,941,548; 4,997,064; 5,092,587; 5,125,877; 5,254,058; 5,256,116; 5,543,185; and 5,593,368.

SUMMARY OF THE INVENTION

The present invention provides improved climbing devices and structures for use in both mobile and fixed climbing systems. The invention provides a variety of modular climbing towers. The towers are generally assembled from panels having lateral curves, most often by fastening upper and lower flanges of the panels together. The panels and flanges are generally integrally molded from fiberglass or the like, and can act as a monocoque structure which is substantially self-supporting. More specifically, the monocoque panel structure often fully supports at least the interior portion of the climbing surface, having a separate frame only for the peripheral edges of the assembled climbing surface, or optionally having no separate frame at all. The climbing surface will generally be disposed on the radially outward portion of a partially or fully enclosed climbing tower formed by the assembled panels. This increases the number of climbers that can safely be accommodated on a climbing surface of a given width. This is particularly advantageous for climbing structures that are limited in width for legal trailering, entry through standard double-doors, and the like.

The present invention also provides belaying devices for safely supporting a climber at the end of a flexible member such as a cable, rope, or the like. These belaying devices generally draw in the flexible member as the climber climbs. When the climber falls or completes the climbing route, the belay device supports the climber's weight, slowly and safely lowering the climber down to the ground. The exemplary auto-belay device makes use of a hydraulic piston mechanism to separate a pair of pulley assemblies. The flexible members runs back and forth between the pulley assemblies with a plurality of windings, so that the stroke of the hydraulic piston can be significantly less than the height of the climbing structure. Such a belay device can safely operate without intervention by another person, significantly increasing the safety without relying on skilled assistants for each climber.

In a first aspect, the invention provides a modular artificial climbing structure. The climbing structure comprises a plurality of panels. Each panel has upper and lower edges, the panel defining a lateral curve with a radially outwardly oriented climbing surface extending between the upper and lower edges. At least one of the lower edges is affixed to the upper edge of an adjacent panel so that the climbing surfaces of the panels define a contiguous climbing area. A plurality of climbing holds are distributed across the combined climbing area. The climbing holds define a plurality of climbing routes, at least a portion of the routes being separated along the lateral curves of the panels.

In many embodiments, the lateral curve of each panel will extend over an arc of at least about 180°. Panels defining smaller arc angles may also be used, often by laterally affixing curving panels together so as to define a combined climbing area having an arc with more than about 120°, the combined arc often being at least about 180°. Such curving climbing areas are particularly advantageous for use in mobile climbing structures, as they allow three or more climbers to be accommodated simultaneously on a structure with the width that is legal for towing. Alternatively, lateral edges of the curving panels can be affixed flush against a wall to define a simple, low cost module climbing structure that does not require a complex or costly installation.

In another aspect, the present invention provides a modular artificial climbing structure comprising a plurality of panels. Each panel has a climbing surface that curves laterally so as to define an arc about an axis. The climbing surface is oriented radially outwardly and extends between left and right edges of the panel. The right edges of at least some of the panels are affixed coaxially to the left edges of adjacent panels so that the climbing surfaces of the panels define a contiguous curved climbing area.

In another aspect, the invention provides a modular artificial climbing structure comprising a plurality of panels. Each panel has a climbing surface bordered by edges. At least some of the panels curve laterally so that the climbing surface is oriented radially outwardly. The edges of the panels are affixed together laterally so that the panels form a circumferentially enclosed tower.

In another aspect, the invention provides a climbing structure for use in a corner between a first wall and a second wall. The first and second walls are at right angles. The climbing structure comprises a plurality of panels. Each panel has a climbing surface curving laterally so that the panel defines an arc of 90°. The climbing surface is oriented radially outwardly and extends between right and left edges. The right edge of at least some of the panels is flush against the first wall. The left edge of at least some of the panels is flush against the second wall. The panels are affixed together so that the arcs of the panels radially enclose the corner.

In another aspect, the invention provides a belay device for use by at least one climber when climbing an artificial climbing structure. The belay device comprises a flexible member having a first end for attachment to a climber. A first pulley assembly is affixed to the artificial climbing structure. A second pulley assembly is also provided, with the flexible member having a plurality of windings extending between the first pulley assembly and the second pulley assembly. The mechanism couples the second pulley assembly to the artificial climbing structure. The mechanism urges the second pulley assembly away from the first pulley assembly with a first force so as to avoid slack in the flexible member when the climber moves upward. The mechanism resists movement of the second pulley assembly toward the first pulley assembly with a second force that is larger than the first force so as to prevent injury to the climber when the climber is supported by the flexible member.

DETAILED DESCRIPTION OF THE SPECIFIC EMBODIMENTS

Figure 1:
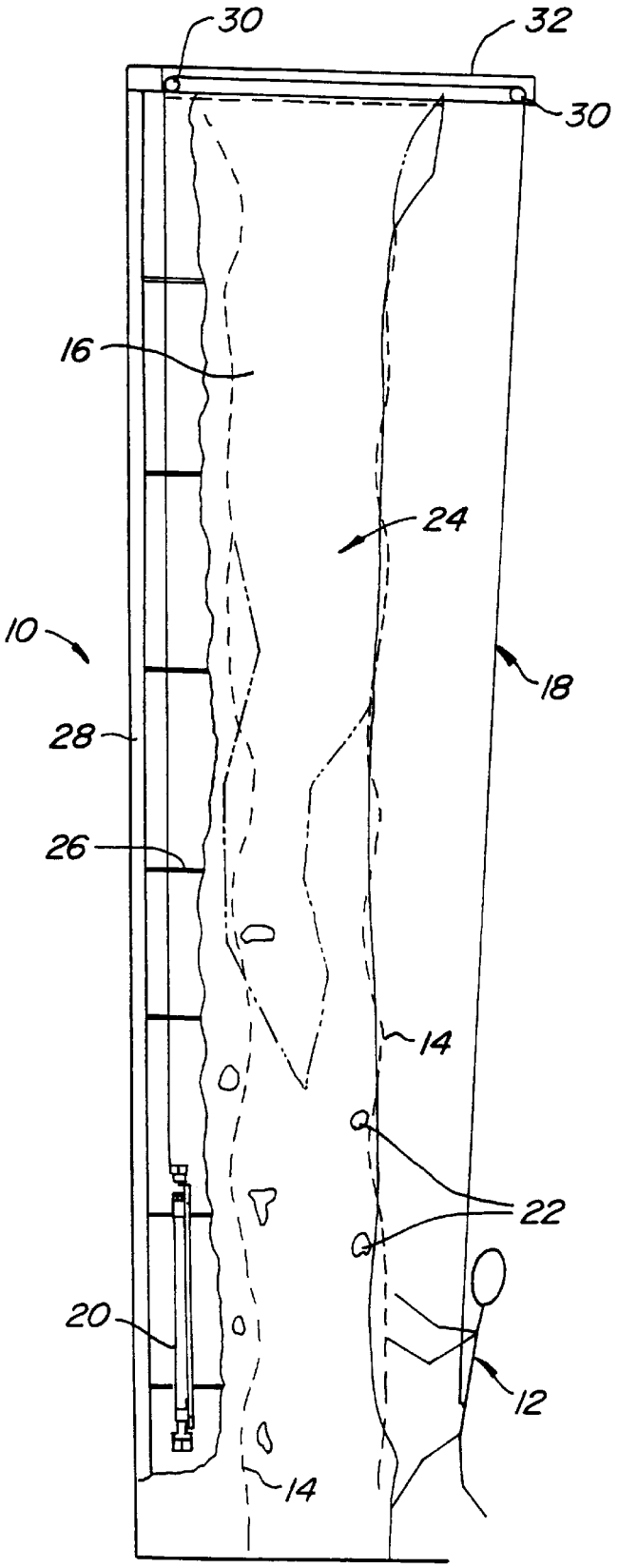
FIG. 1 illustrates a modular climbing tower according to the principles of the present invention, in which a portion of the tower is shown removed to illustrate an auto-belay mechanism.

FIG. 1 schematically illustrates a climbing system 10 in which a climber 12 ascends a route 14 of a climbing tower 16. As climber 12 moves upward, a gentle tension is maintained in a flexible member 18 leading upward from climber 12 using auto-belay device 20. Climber 12 generally climbs upward by grasping and/or stepping on climbing holds 22 that are affixed to or molded in a climbing surface 24 of tower 16.

Flexible member 18 provides only negligible support to climber 12 while climbing. However, when climber 12 lets go or falls from climbing surface 24, auto-belay device 20 limits the speed at which flexible member 18 can be pulled downward, thereby safely and gently lowering the climber to the ground.

Climbing tower 16 is generally assembled by affixing a series of curving panels together. Each panel will generally have radially inwardly oriented flanges 26, so that the tower can be assembled by affixing the flanges of adjacent panels together. These flanges may be affixed using fasteners such as bolts, clamps, or the like. Additionally, a frame 28 may be affixed around the peripheral edge of climbing surface 24. The panels will preferably be molded with sufficient structural strength to support holds 22 of climbing surface 24 with a monocoque structure, so that a complex frame is not needed behind climbing surface 24.

As the panels that define climbing surface 24 are molded, at least some of the features used to climb tower 16 may be molded directly into the panels. Additionally, commercially available climbing holds 22 may be affixed to climbing surface 24 in a substantially conventional manner. Preferably, the panels will be molded from fiberglass, ideally having a 2,000 lb. pull strength per handhold. Attachment of commercially available handholds is facilitated by including nuts embedded in the fiberglass, so that a bolt can be passed through each hold to fasten the hold to the wall. The panels may be uniform or may vary so that the climber encounters different features as she climbs.

Figure 1A:
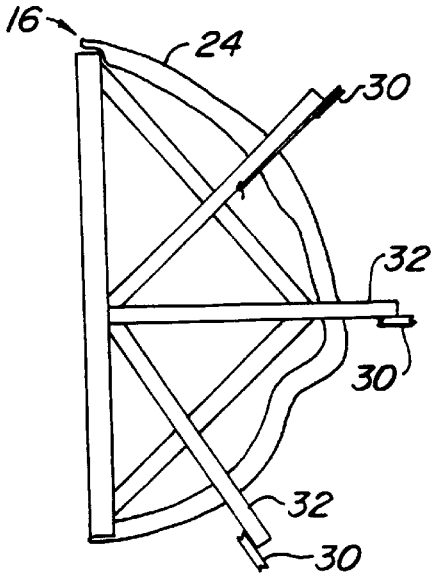
FIG. 1A is a top view of the climbing tower of FIG. 1, showing the lateral curve of the modular panels which helps avoid interference between climbers on adjacent routes.

As can be understood with reference to FIGS. 1 and 1A, holds 22 are generally arranged across the curving climbing surface 24 so as to define a plurality of climbing routes 14. An auto-belay device 20 will be provided for each route 14, with flexible member 18 leading from climber 12 to the auto-belay mechanism through guide pulleys 30. At least some of these pulleys are mounted on davits 32, the davits typically comprising cantilevered square steel tubes having a strength of about 5,000 lb.

Figure 2:
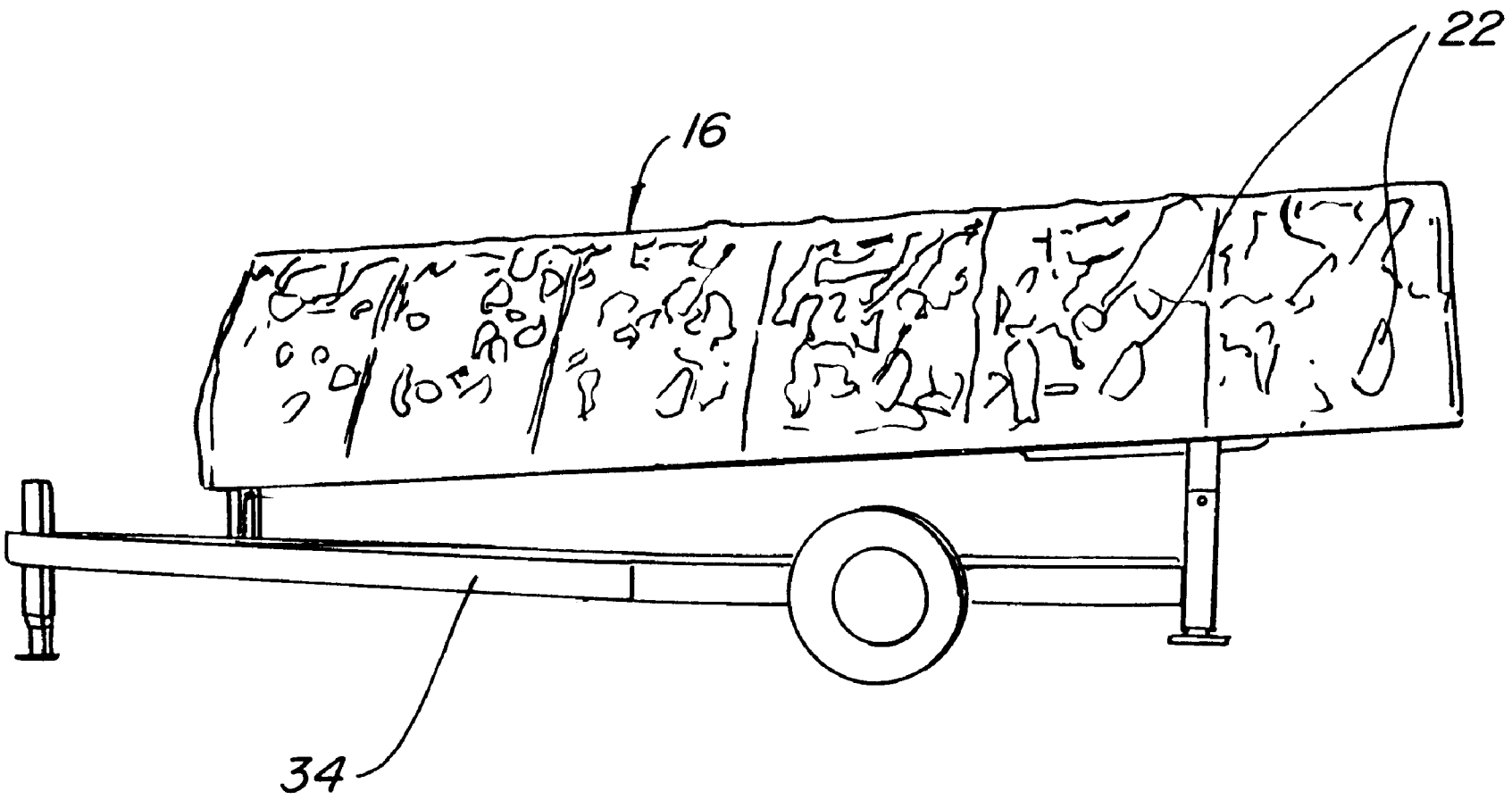
FIG. 2 is a side view of the modular tower of FIG.1 affixed to a trailer, in which the tower is in a lateral orientation for transportation.
Figure 3:
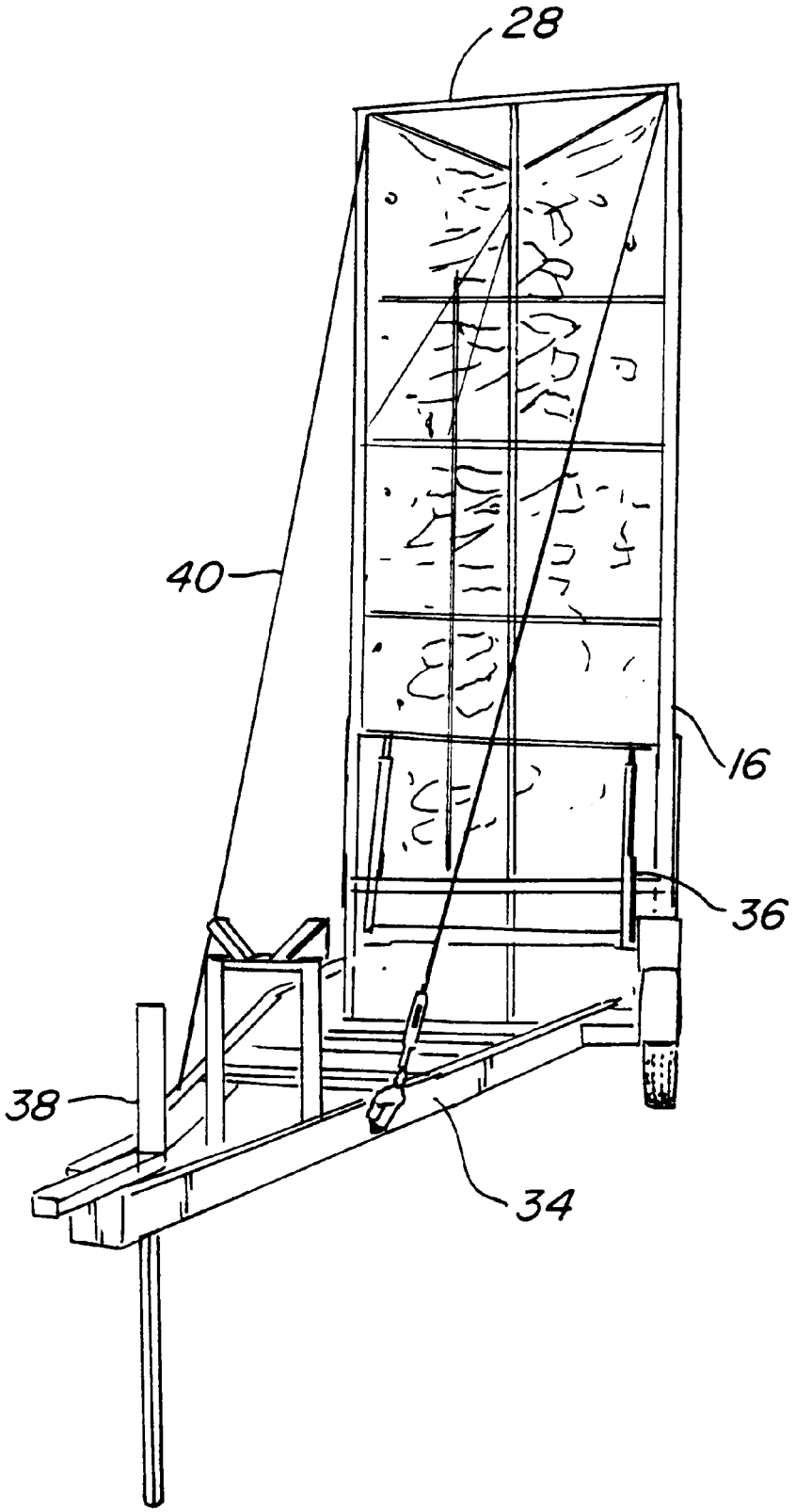
FIG. 3 is a back view of the modular climbing tower of FIG. 1, showing the pivot and lift mechanism used to tilt the tower upward.
Figure 4:
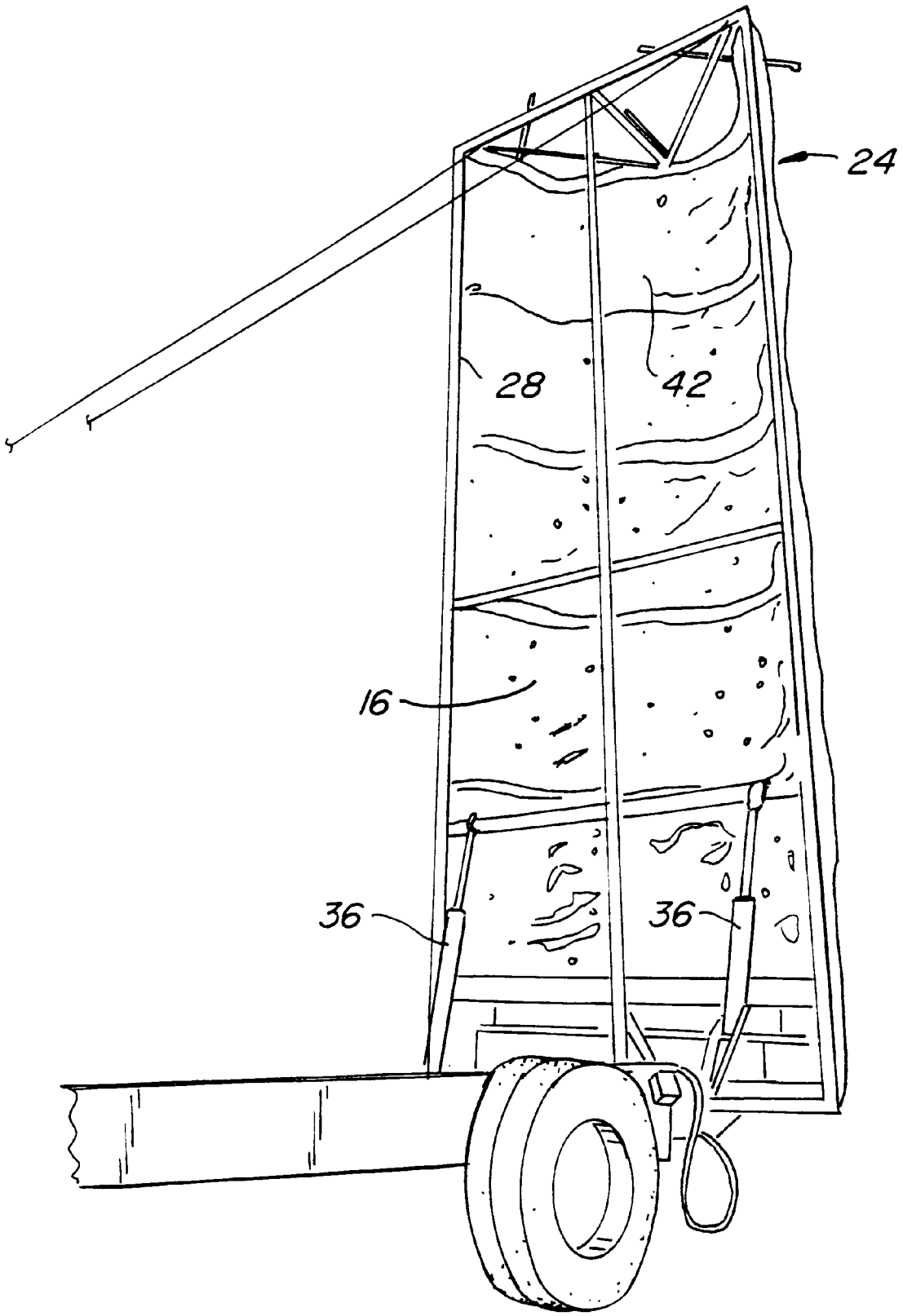
FIG. 4 is a detailed perspective view showing the inner structure of the modular tower of FIG. 1.
Figure 5:
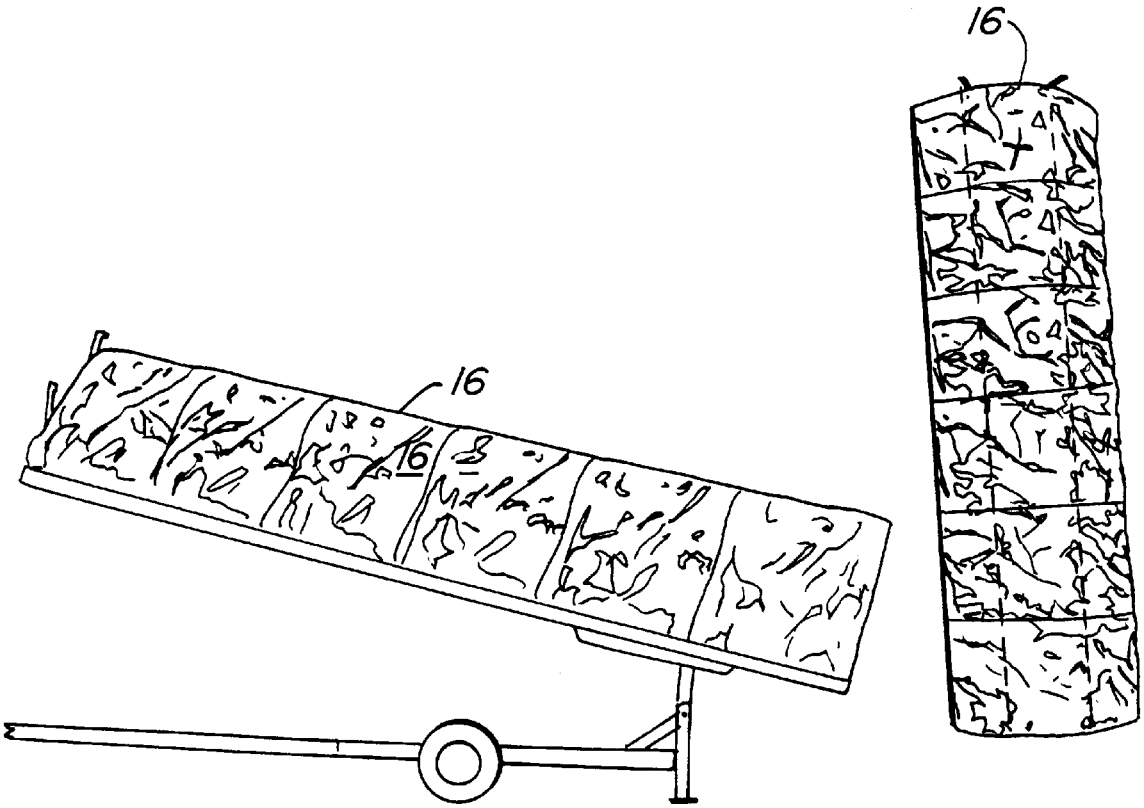
FIG. 5 illustrates a tower pivoting upward for use, adjacent a tower which is already in the vertical orientation.

FIG. 2 illustrates climbing tower 16 mounted on a trailer 34 so as to provide a mobile climbing system. Climbing tower 16 is pivotable between a horizontal position (as shown in FIG. 2) and a vertical position (as can be seen in FIGS. 3–5). In the exemplary embodiment, electro-hydraulic actuators 36 tilt tower 16 about a pivot. Suitable electro-hydraulic actuator are commercially available for use in dump trucks and the like, and may be powered by batteries carried on trailer body 34.

To help stabilize tower 16 when climbing, and to level the tower when it is to be used on an uneven surface, three lift jacks 38 are provided at the front and rear corners of trailer 34. Cables 40 and a water ballast tank on trailer 34 can be used to help stabilize the tower when in the vertical orientation, while a mechanical latch can be provided to secure the tower in the horizontal orientation for transportation. Optionally, electrically powered lift jacks may be used in place of the manual jacks that are shown.

Preferably, tower 16 as mounted to trailer 34 provides a total overall width which is sufficiently small to be legally trailered without a special permit. It is generally preferable to minimize the overall height of the trailered tower as well. The exemplary embodiment is generally sufficiently small to both be legally towed, and to fit through a standard set of double wide doors for access to gyms or covered events. Despite this relatively narrow width, the use of a curved climbing surface allows tower 16 to accommodate three climbers simultaneously, as can be understood with reference to FIG. 1A.

Figure 6:
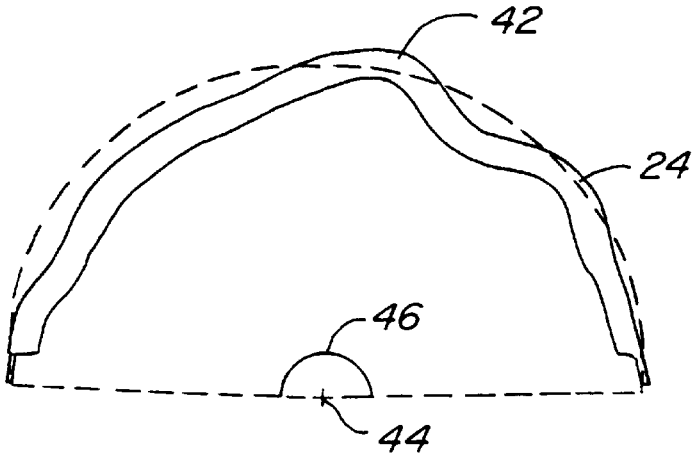
FIG. 6 illustrates an arc defined by the laterally curving panels of the present invention.

As has generally been described above, tower 16 is formed by assembling a series of molded fiberglass panels. Preferably, the tower is formed primarily using panels that curve laterally, as can be understood with reference to FIGS. 1A and 6. As described above, a panel 42 can be molded and textured to provide integral handholds, either alone or in combination with commercially available climbing holds affixed to climbing surface 24. Despite the irregularities of the molded features, panel 42 generally curves laterally about an axis 44 so as to define an arc angle 46 of about 180°. Hence, the climbing surface 24 of panel 42 is substantially cylindrical.

As can be understood with reference to FIGS. 1–5, climbing surface 24 need not be (and preferably is not) a perfect half-cylinder. The molded features of the climbing surface generally enhance the climbing experience by providing alternative (and often more challenging) climbing holds than those that are separately affixed onto the climbing surface. While the cross-section will often be somewhat irregular, the cross-section of adjacent panels at the panel interface joints will often match quite closely to avoid unintended ledges or gaps.

Figure 7:
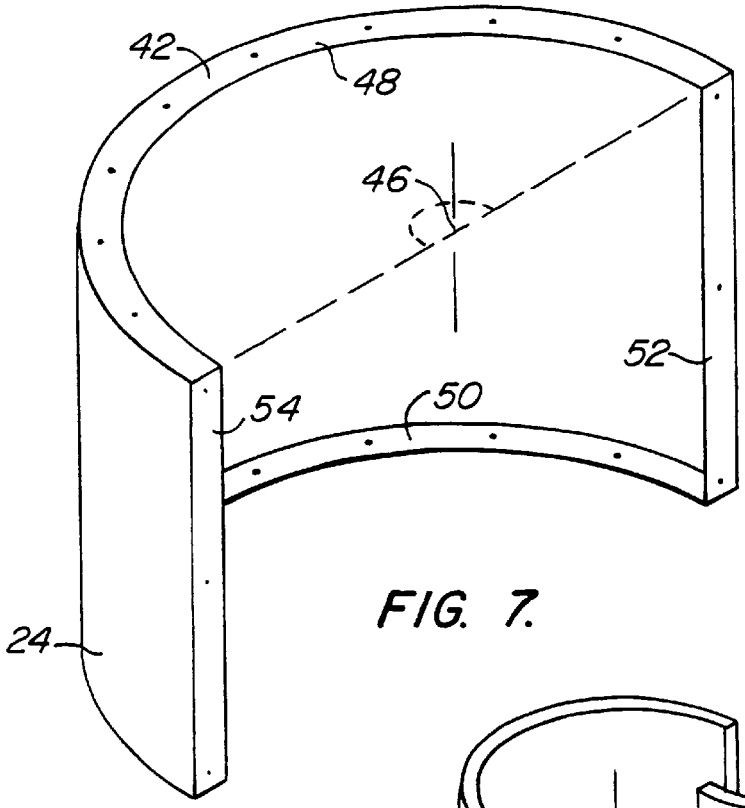
FIG. 7 schematically illustrates a modular climbing structure panel having integrally molded upper, lower, left and right flanges.
Figure 8:
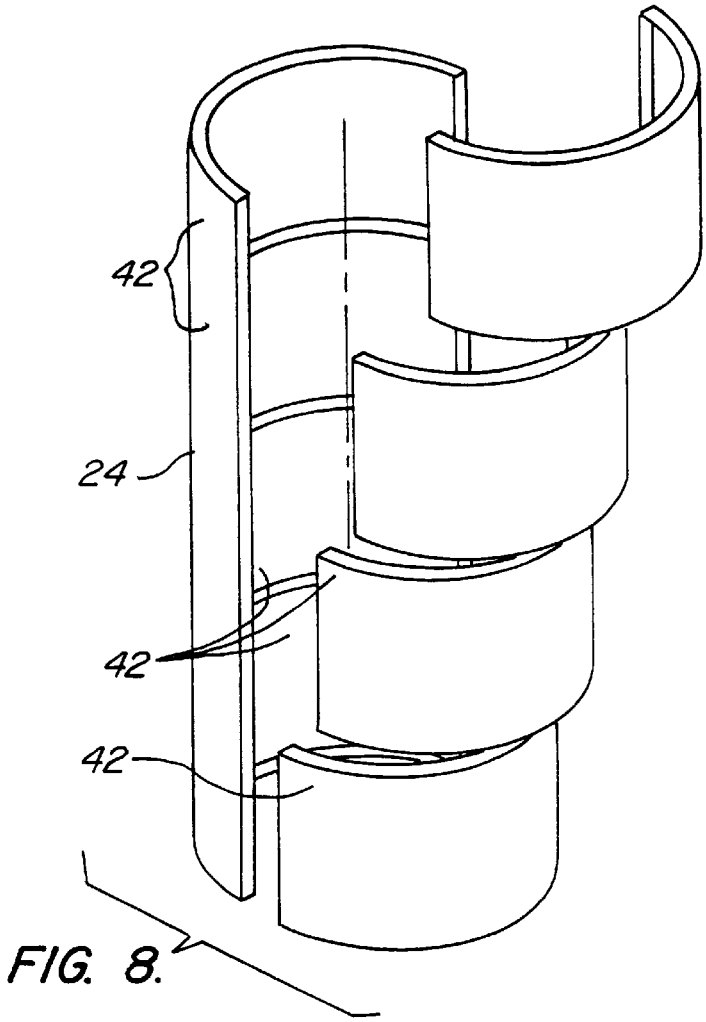
FIG. 8 is an exploded view of a circumferentially enclosed monocoque climbing tower assembled from the modular panels of FIG. 7.

Despite the fact that the panel will often have a somewhat irregular surface, it is useful to model the panel as cylindrical for simplicity, as illustrated in FIG. 7. Panel 42 has a climbing surface 24 that describes an arc angle 46 of 180°, as described above. Additionally, upper and lower flanges 48, 50 extend radially inward from climbing surface 24 to facilitate affixing the panels together in a vertical tower. In some embodiments, right and left flanges 52, 54 may also be provided to facilitate affixing laterally adjacent panels together to provide a circumferentially contiguous climbing surface. For example, a series of eight panels 42 can be affixed together both laterally and vertically to form an enclosed tower as illustrated in FIG. 8.

When connecting panels together, the adjacent flanges will often be temporarily clamped together so that the clamped flanges can be drilled. Once the flanges are drilled, a fastener such as a nut and bolt can be used to affix the flanges. Alternatively, adhesive may be spread over the engaging surface of one or both of the flanges prior to clamping, or the flanges might be rivetted, welded, or the like. Regardless, the panels of the present invention will often be affixed together substantially coaxially, as can also be understood with reference to FIG. 8.

In the exemplary embodiment, panels 42 comprise a polyester fiberglass composite structure. Alternative materials that might be used include polyurethane, ceramic, polymerized concrete, stucco, or other building materials. As is seen most clearly in FIG. 4, modules 42 are supported by peripheral frame 28, which is preferably strong enough to support the climber. Frame 28 is formed primarily of steel box tubing, and is welded together. Panels 42 are individually about 8 feet wide with an axial length of about 4 feet. In the embodiments of FIGS. 1–5, six of panels 24 are affixed vertically to provide a climbing surface having a height of about 24 feet. Advantageously, the total height of the climbing surface can be controlled by using a different number of modules.

Figure 9:
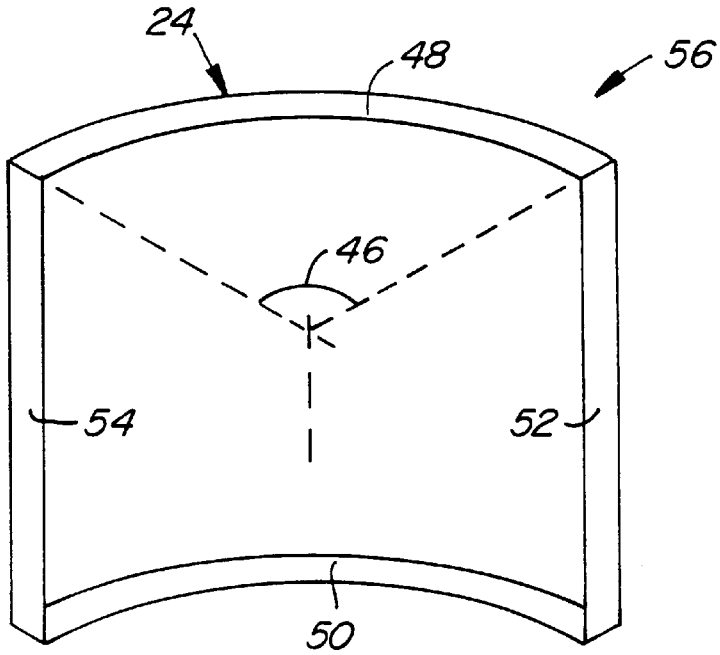
FIG. 9 schematically illustrates a modular curving panel that defines an arc angle of 90°.
Figure 10:
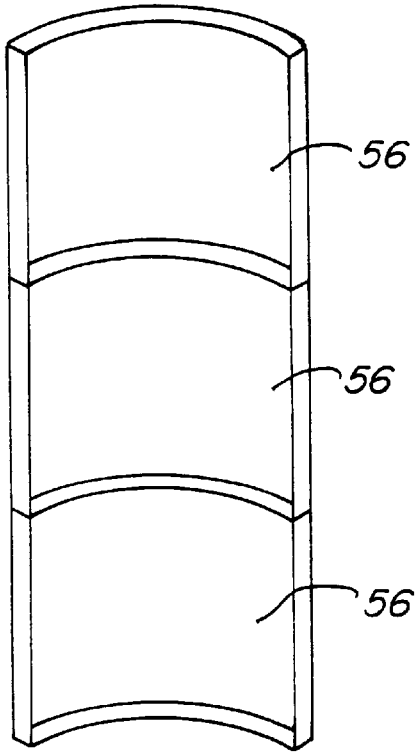
FIGS. 10 and 10A illustrate a climbing tower assembled from the panels of FIG. 9, particularly for use in interior corners.
Figure 10A:
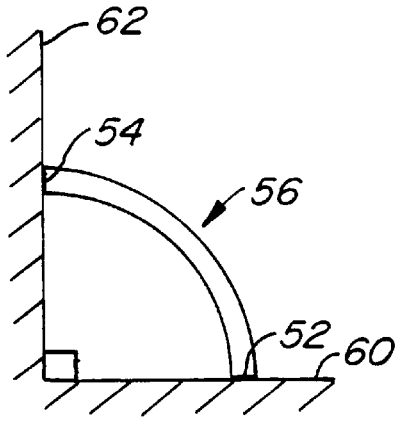

A particularly advantageous alternative panel structure is schematically illustrated in FIG. 9. Panel 56 is substantially similar to panel 42 of FIG. 7, but here defines an arc angle 46 of 90°. As can be understood with reference to FIGS. 10–12, one, two or three 90° panels can conveniently be affixed together laterally to define climbing towers which fit within internal corners, flush against a wall, or circumferentially encircle an external corner, as desired.

Figure 11:
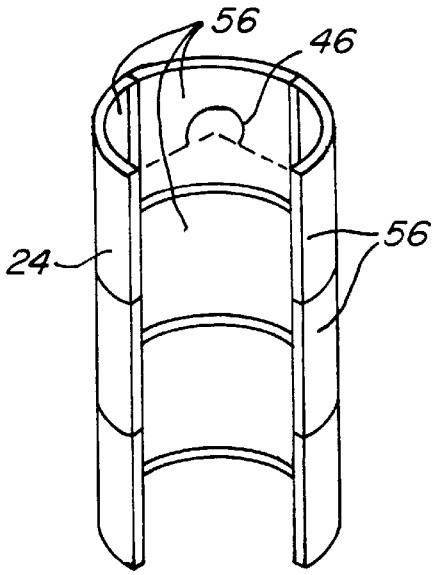
FIGS. 11 and 11A illustrate modular climbing towers assembled from the panels of FIG. 9 for use along exterior corners.
Figure 11A:
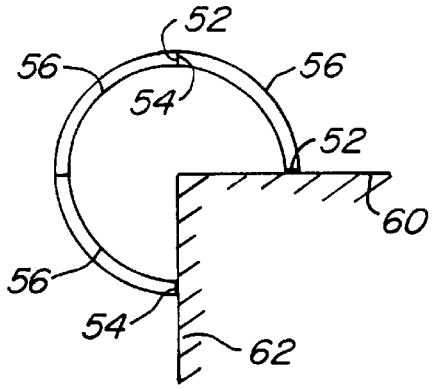
Figure 12:
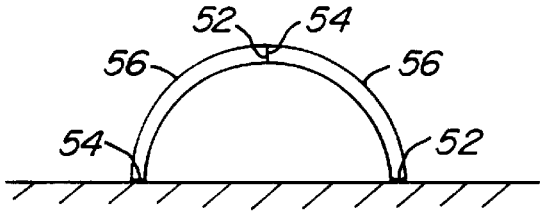
FIG. 12 is a top view of a climbing tower assembled from the panels of FIG. 9 for use along a straight wall.

In fixed installations, at least some of right flanges 52 will be affixed flush against a first wall 60, while at least some of left flanges 54 will be affixed flush against a second wall 62. As seen in FIGS. 11 and 12, affixing right flanges 52 to left flanges 54 of an adjacent panel allows a plurality of 90° panels to define combined arc angles of 180°, 270°, or 360°.

When affixing flanges to walls, as when affixing flanges to other flanges, a wide variety of alternative mechanisms might be used. Flanges might be bonded, bolted, or welded to the walls and/or floor for fixed installations. In some embodiments, frames may first be attached to the walls, with the panels then being attached to the walls via the frames. A particularly advantageous anchor bolt for affixing towers to concrete foundations or walls is commercially available from Simpson Strong-Tie connectors and sold under the trademark SSTB®.

Figure 13A:
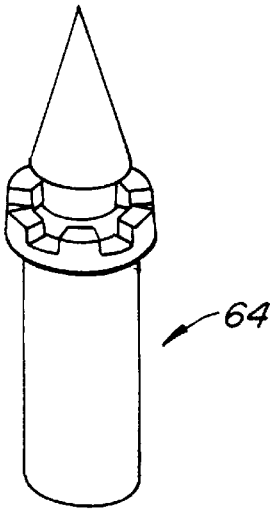
FIGS. 13 and 13A illustrate circumferentially enclosed modular climbing towers assembled from the panel of FIG. 9.
Figure 13:
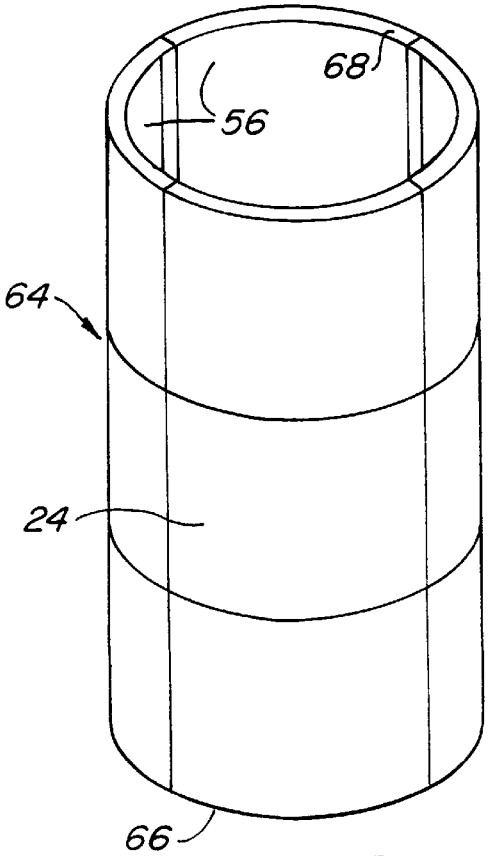

A particularly advantageous circumferentially enclosed tower formed by assembling 90° panels 56 is illustrated in FIGS. 13 and 13A. The panels and flanges may optionally provide sufficient strength as a monocoque structure that no further support is needed. Alternatively, a partial frame may extend within enclosed tower 64 from adjacent a bottom 66 to adjacent a top 68, so as to help support davits 32 or the like. Nonetheless, the monocoque structure will often be strong enough to fully support climbing surface 24 between bottom 66 and top 68.

Figure 14A:
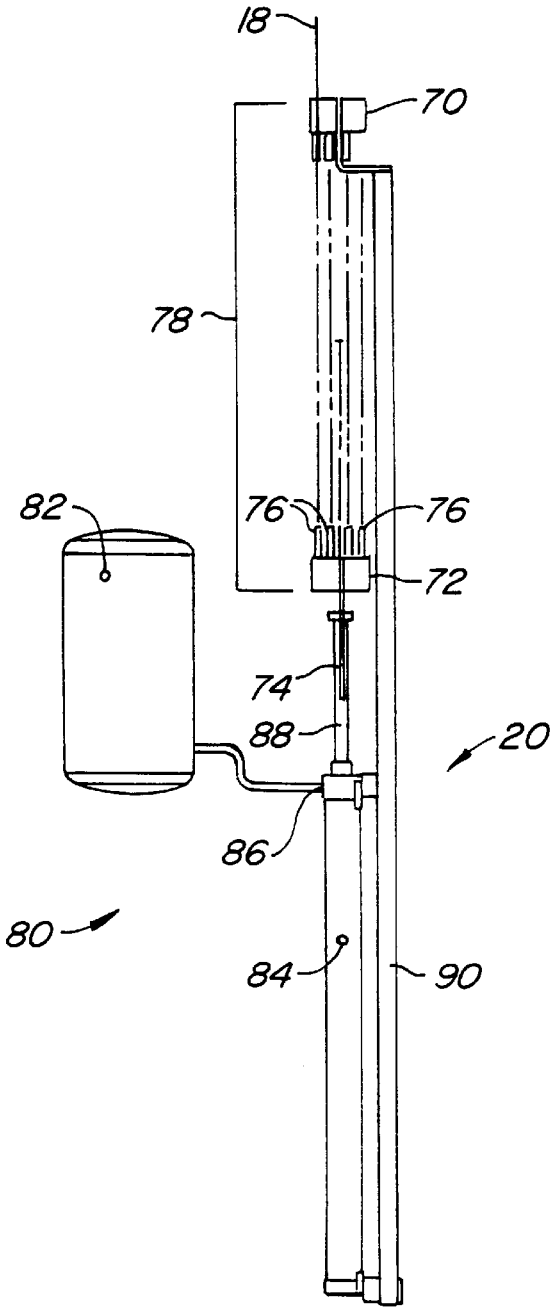
FIGS. 14 and 14A are a perspective view and a side view, respectively, of a hydraulic auto-belay device.
Figure 14:
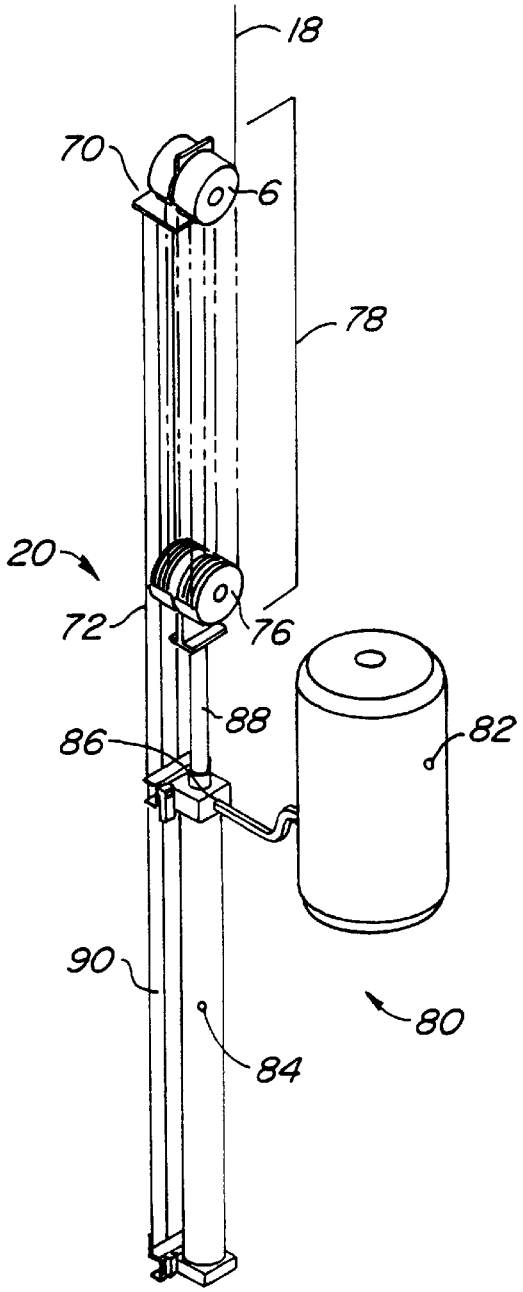

The exemplary auto-belay device 20 is seen most clearly in FIGS. 14 and 14A. Belay device 20 includes a first pulley assembly 70 that is affixed to frame 28 of tower 16. A second pulley assembly 72 moves along a pulley path 74, as can be seen in FIG. 14A.

Each of pulley assemblies 70, 72 include a plurality of pulleys 76, and flexible member 18 extends back and forth over the pulleys of the pulley assemblies with a plurality of windings 78. This provides a block-and-tackle arrangement with a mechanical advantage that depends on the number of pulleys and windings; the larger the number of windings the greater the total movement in flexible member 18 at the climber for each inch of movement in second pulley assembly 72.

The position of second pulley assembly 72 along pulley path 74 is generally determined by hydraulic mechanism 80. In general, hydraulic mechanism 80 biases second pulley assembly 72 away from first pulley assembly 70 so as to gently draw flexible member 18 up and over the wall (via guide pulleys 30, see FIG. 1) as the climber climbs. When the climber finishes climbing, lets go, falls, or otherwise puts a significant tension load on flexible member 18, the hydraulic mechanism resists movement of second pulley assembly 72 towards first pulley assembly 70 with sufficient force to substantially support the climber.

In general, hydraulic mechanism 80 biases the second pulley assemblies apart so as to only gently pull on flexible member 18 without significantly assisting the climber up the tower. In the exemplary embodiment, flexible member 18 pulls upward on the climber with a force of about 15 lb. However, when the climber's weight is supported by flexible member 18, the hydraulic assembly only allows the climber to be lowered at a rate of about 0.5 m/sec. The mechanical advantage provided by the multiple windings and pulleys of the block and-tackle arrangement allows the use of a relatively short pulley path 74 as compared to the total height of the climbing tower.

Hydraulic mechanism 80 includes reservoir 82 containing fluid such as water, a piston/cylinder assembly 74, and an orificed check valve 86. Check valve 86 allows fluid to flow freely from reservoir 82 to piston/cylinder 84, but forces the fluid to flow through a relatively small orifice when returning from the piston/cylinder to the reservoir. It is this restricted flow which limits the speed at which flexible member 18 lowers the climber. Reservoir 82 may be pressurized with air or an inert gas to bias the pulley assemblies apart. A typical gas charge pressure for the reservoir is about 30 to 60 psi. Other biasing mechanisms could be used with or instead of gas pressure. A weighted pulley assembly might use gravity as the biasing force. In some embodiments, a position of reservoir 82 sufficiently above piston/cylinder assembly 84 provides a pressure head that gently biases the pulley assemblies apart. Multiple climbers are often accommodated by providing a check valve and piston/cylinder assembly (coupled to a dedicated cable and block-and-tackle) for each climber, all of which an be coupled to a single common reservoir. The reservoir and hydraulic system preferably contain hydraulic oil or automatic transmission fluid.

It should be noted that in this preferred assembly, a piston rod 88 coupling second pulley assembly 72 to the piston within the piston/cylinder assembly 84 is loaded in tension. This is generally accomplished by coupling reservoir 82 to the cylinder between the piston and a sliding piston rod seal (where the piston rod enters the piston/cylinder assembly). The use of a piston rod loaded in tension rather than compression avoids buckling of the relatively long piston rod or cylinder structures.

Figure 15:
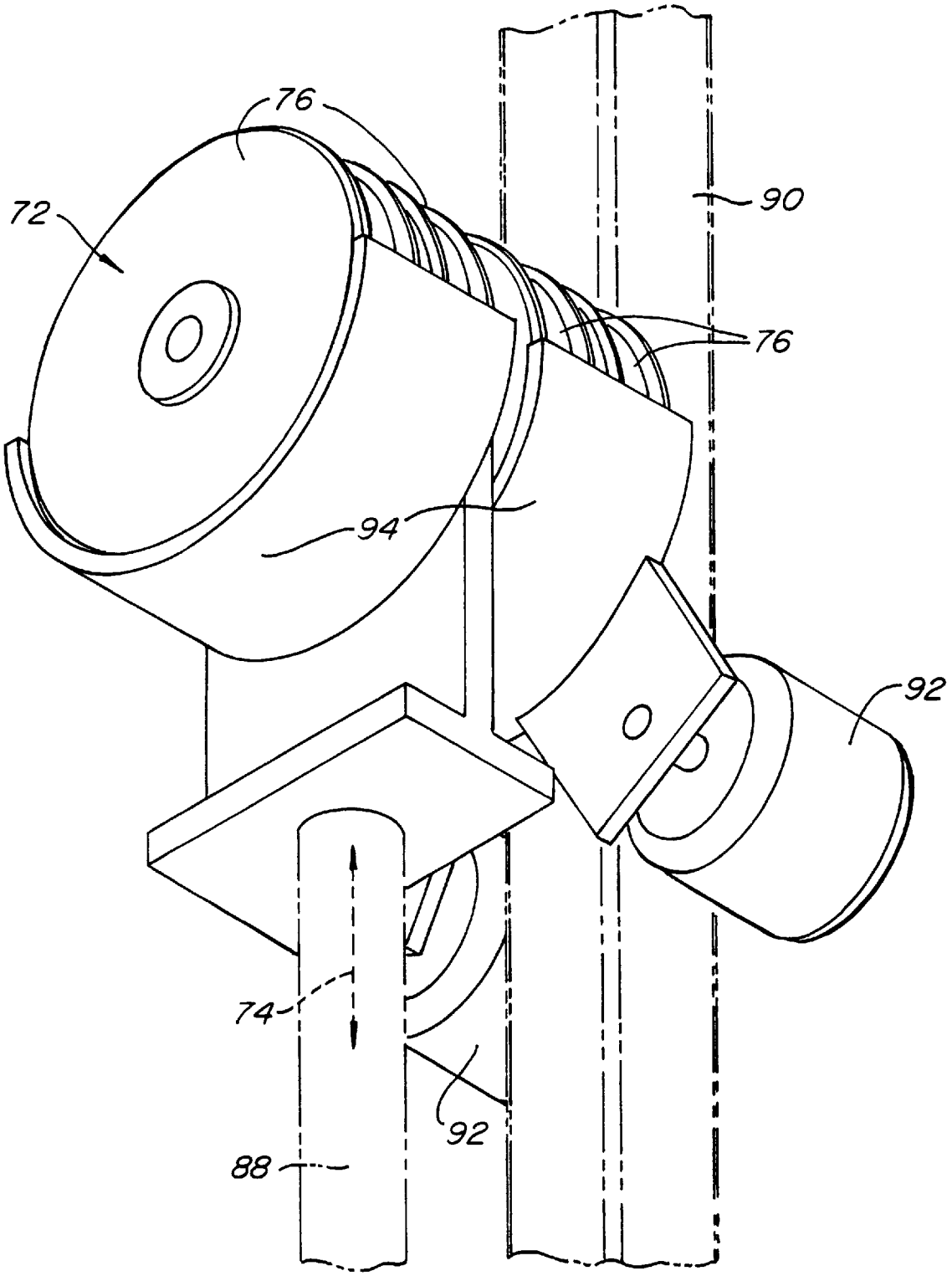
FIG. 15 is a perspective view of a pulley assembly of the belay device of FIG. 14, showing a guide member having wheels in rolling contact with a guide structure.

Many of the components of belay device 20 are mounted on a belay frame member 90. Referring now to FIG. 15, belay frame 90 also acts as a guide member to prevent misalignment between second pulley assembly 72 and the first pulley assembly. More specifically, skateboard wheels 92 mounted to first pulley assembly 72 rollingly engage belay frame 90 as the pulley assembly travels up and down along pulley path 74. This helps prevent frictional contact between the windings of flexible member 18 which might otherwise occur if second pulley assembly 72 were to twist about the axis of piston rod 88. It is particularly advantageous to avoid cable-to-cable contact when using a cable, as such contact can result in rapid wear.

The mounting of pulley 76 can also be seen in more detail in FIG. 15. Pulley 76 may be any of a wide variety of commercially available pulleys, the pulleys preferably comprising an injection molded polymer and having a bearing that accommodates a 0.5 in mounting shaft. Preferably, pulley guards 94 are mounted sufficiently close to pulley 76 so that flexible member 18 (not shown in FIG. 15 for clarity) cannot slip axially off the pulley. Such pulley guards will preferably also be provided for pulleys 30 mounted on davit 32. Belay device frame 90 will generally comprise a 2.0 in steel box beam having a length of about 6 feet. In the exemplary embodiment, each pulley assembly has four pulleys. Depending on the number of windings and the height of the climbing wall, piston/cylinder assembly 84 may have a stroke of about 3 or 4 feet.

Figure 16:
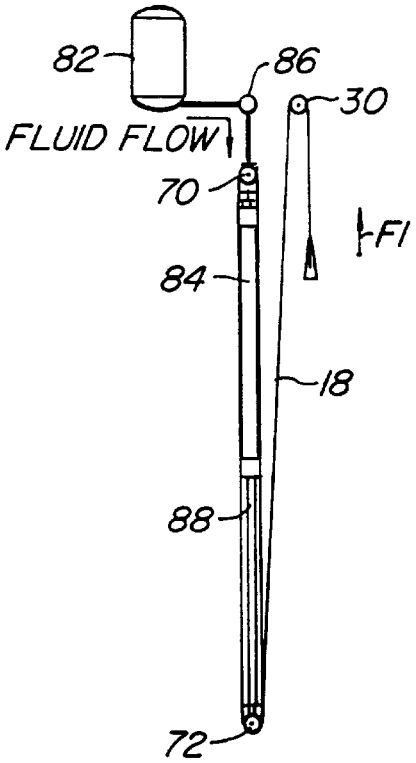
FIG. 16 schematically illustrates the operation of a belay system similar to that of FIG. 14 while the climber is ascending.
Figure 17:
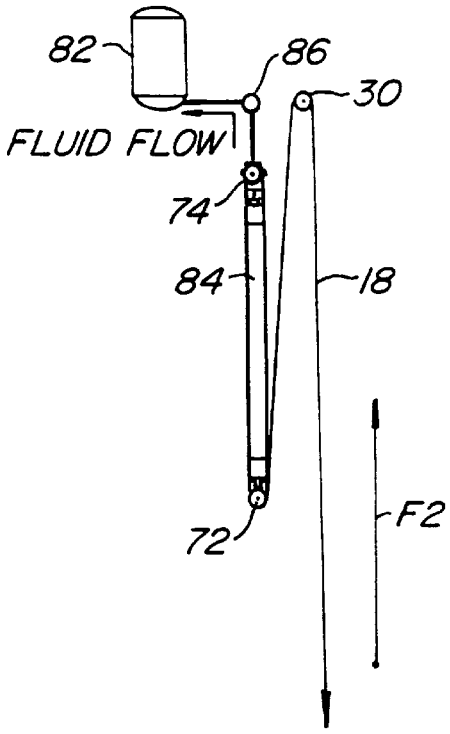
FIG. 17 schematically illustrates the operation of the auto-belay mechanism while the mechanism is supporting the weight of a climber.

The operation and advantages of hydraulic mechanism 80 can be understood with reference to FIGS. 16–19. It should be noted, however, that the piston/cylinder assembly 84 of the embodiment illustrated in FIGS. 16 and 17 is loaded in compression, rather than tension.

As the climber climbs, fluid from reservoir 82 flows unrestricted through check valve 86 and into piston/cylinder assembly 84 so as to urge second pulley assembly 72 away from first pulley assembly 71. The block-and-tackle mechanical advantage arrangement draws in several inches of flexible member 18 for each inch second pulley assembly 72 moves, while the flexible member imposes a relatively light upward force Fl on the climber. It should be noted that fluid is provided on only one side of the piston, while the other is open to the atmosphere. A filter may be provided on the open end of the cylinder to prevent contaminating particles from entering the cylinder.

As reservoir 82 is disposed above the piston/cylinder assembly, any air within the hydraulic system will generally tend to float upward, thereby assuring that the cylinder remains filled with fluid. Even if the conduit between the reservoir and check valve should become detached, this would simply prevent the hydraulic system from drawing in flexible member 18 as the climber climbs upward, thereby alerting the climber of a failure. Even under such conditions, the weight of the climber could still be supported by the hydraulic system as the climber descended, as fluid would simply squirt out as second pulley assembly 72 was forced towards first pulley assembly 70.

In the exemplary embodiment, flexible member 18 comprises a 3/16 inch stainless steel cable. One end of the cable is affixed, preferably to some structure attached to the belay frame. As described above, the other end of the cable is attached to the climber. This will generally be accomplished using any of a wide variety of rock climbing harnesses that are commercially available from a wide variety of sources.

Figure 19:
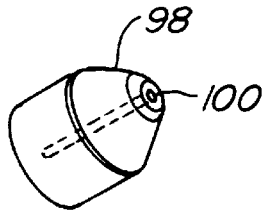
FIG. 19 illustrates a modified one-way valve sealing member that has been drilled to gently lower a climber.

As flexible member 18 is kept taut while the climber is climbing, and as the flexible member is preferably inelastic in length, the climber's weight will immediately pressurize the fluid in piston/cylinder assembly 84 if the climber should fall. When the pressure of the fluid in the cylinder is greater than that of the fluid in the reservoir, fluid will attempt to flow in the reverse direction past one-way valve 86, as illustrated in FIG. 17. Such reverse flow through a one-way valve generally actuates the valve so as to prevent flow. However, in this one-way valve, the sealing member 98 has an orifice 100 with a predetermined diameter, as shown in FIG. 19. This orifice greatly restricts flow through the one-way valve in the reverse direction, but does gradually allow the fluid to return towards the reservoir from the piston/cylinder assembly. This greatly reduced flow supports the climber with a force F2 via flexible member 18, and gently lowers the climber back to ground level. The exemplary one-way valves are sold by Parker under the tradename VCR® and VR®, and are drilled to provide an orifice with a diameter of between 0.40 in. and 0.60 in.

In the exemplary embodiment, sealing member 98 comprises a standard floating Delrin® piston contained in a valve chamber having a conventional tapering valve seat. More generally, the piston may comprise any polyacetal material. Sealing member 98 includes a tapering surface that mates with the valve seat to seal around the perimeter of the valve when reverse flow starts, but allows limited flow through orifice 100. Similar effects might be provided by drilling an orifice hole through the sealing member of a flapper valve, or by providing a portion of a spring or other structure between the tapering portion of sealing member 98 and its mating valve seat.

Figure 18:
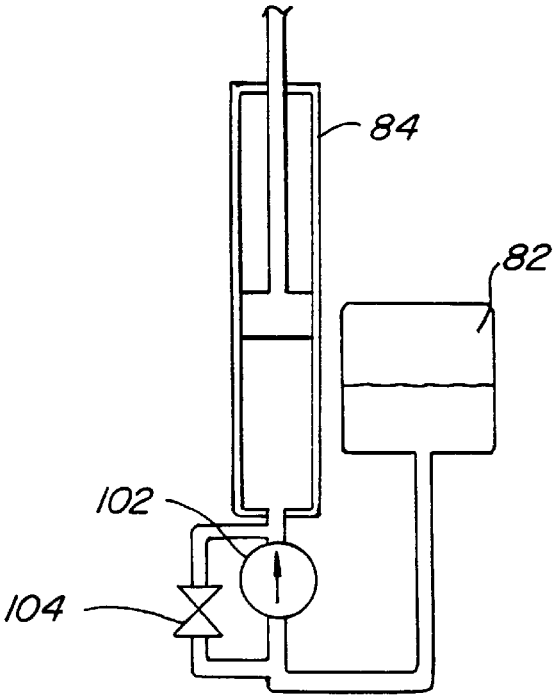
FIG. 18 schematically illustrates an alternative hydraulic arrangement having separate one-way and flow restrictor valves.

Still further alternative hydraulic arrangements are possible, one of which is illustrated in FIG. 18. Rather than using a single orificed check valve, this embodiment makes use of a separate check valve 102 and flow restrictor 104. These components are arranged in parallel, so that fluid will flow freely in the forward direction of the check valve, but must pass through the flow restrictor when flowing in the reverse direction (from the piston/cylinder assembly 84 towards reservoir 82). It should be noted that reservoir 82 will preferably be mounted so that the fluid level remains above the height of the piston/cylinder assembly, as described above. The flow restrictor may optionally be a variable position valve to change the rate of descent.

Figure 20:
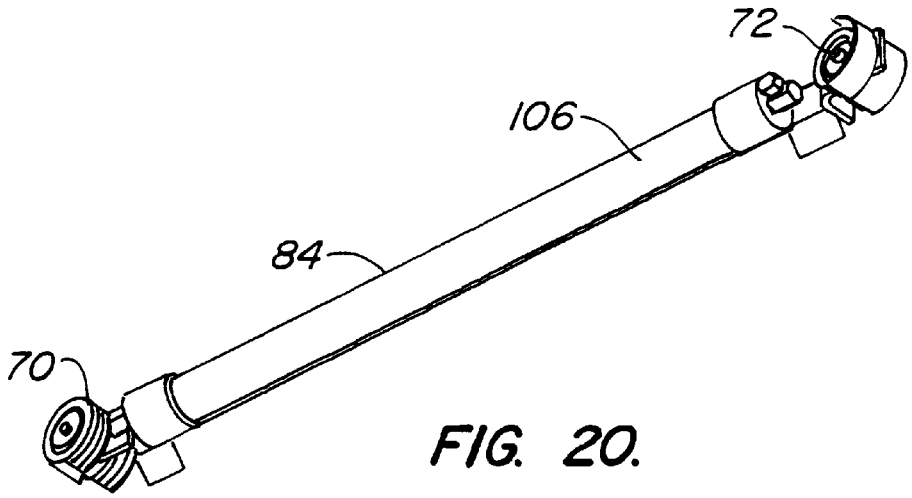
FIG. 20 is a perspective view of a hydraulic ram assembly for use in compression.
Figure 21:
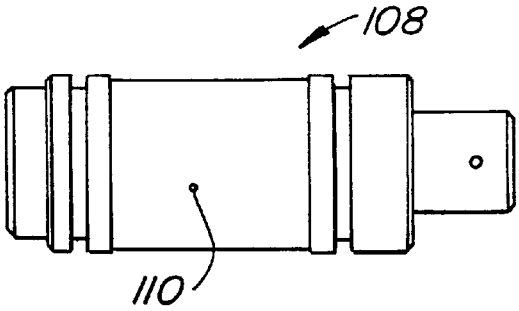
FIG. 21 is a detail view of the piston for use in the hydraulic ram of FIG. 20.

Referring now to FIGS. 20 and 21, the hydraulic piston/cylinder assembly 84 includes a cylinder 106 having an internal diameter of about 2.5 in. Within cylinder 106, piston 108 has a length that is significantly greater than its diameter, typically being about 5.0 in in total length. Piston 108 accommodate piston seal rings adjacent each end to avoid lateral jamming when side forces are imposed. Piston 108 has a central portion 110 with a smaller diameter than the piston adjacent the seals so as to avoid jamming of the piston if the chamber bends slightly. The piston may comprise steel, aluminum Delrin® (a polyacetal), or the like. The cylinder may comprise any of these materials or polyester, polyvinyl, or the like. Suitable hydraulic rams are commercially available from Parker, Prince, A.R.O., and others.

In the embodiment illustrated in FIG. 20, cylinder 106 provides a stroke of about 3 feet. Piston 108 is coupled to pulley assembly 72 by a steel shaft, and the pulley assemblies each include a total of four pulleys 76, thereby providing flexible member 18 with sufficient range of motion to accommodate a 24 foot high climbing tower. As described above, it is generally preferable to rearrange pulley assemblies 70, 72 so that the hydraulic piston/cylinder operates in tension rather than compression so as to avoid buckling.

In general, the elements of hydraulic mechanism 80 will preferably be coupled using hoses and fittings having sufficient strength to withstand up to 4,000 psi. These hydraulic structures will generally operate at pressures of about 30 psi to 35 psi, thereby providing a substantial factor of safety. The hydraulic assemblies and harness coupling can be coupled to the cable using copper crimps. Such crimps can provide strength equal to 100% of that of the cable, which will typically be over about 4,000 lb.

As described above, failure of the hydraulic system will generally result in a safe lowering of the climber to the ground, but will then fail to draw up the cable to allow a subsequent climber to ascend the tower, thereby providing a fail safe operation. A further advantage of the system is that the actual force function imposed by the auto-belay device 20 on the climber through flexible member 18 during a fall is trapezoidal in shape. In other words, the force will gradually ramp-up due to inherent resilience within the system, thereby avoiding the imposition of a step load force function which might injure a climber. Furthermore, by using a light but constant tension on an inelastic flexible member, the total distance the climber will drop is significantly less than would occur if traditional resilient climbing ropes were used. Nonetheless, the structure and operation of the device might be combined with alternative flexible members such as standard resilient climbing ropes, inelastic repelling ropes, ropes incorporating high strength fibers, or the like.

Figure 22:
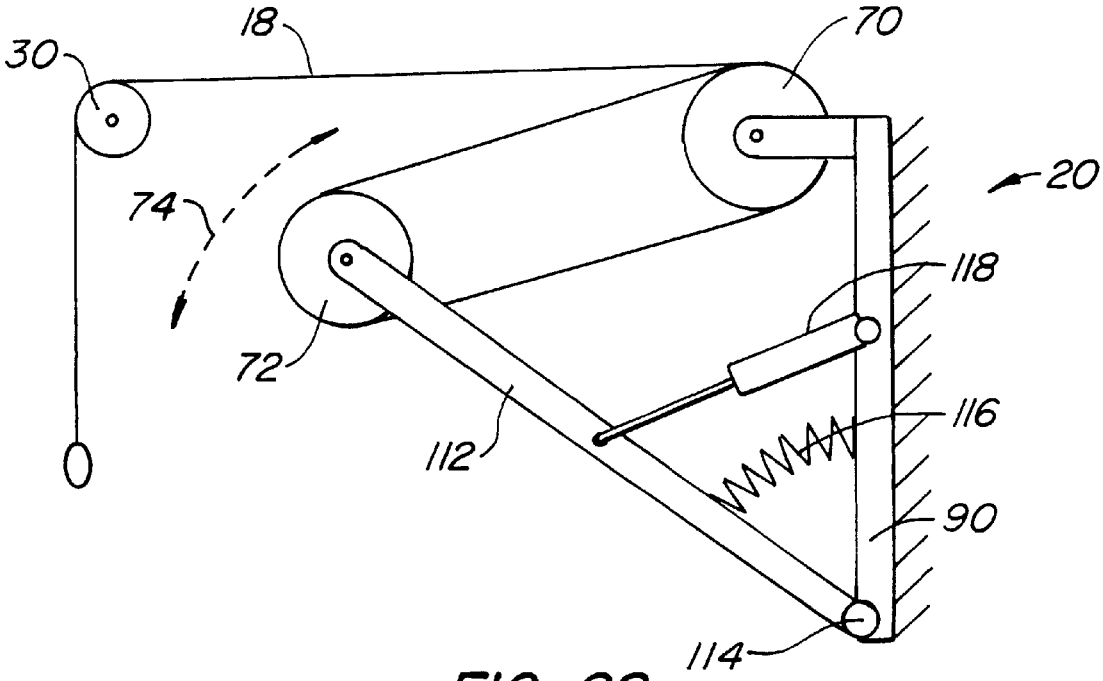
FIG. 22 schematically illustrates an alternative mechanism for controlling the distance between a pair of pulley assemblies in an auto-belay device.

Referring now to FIG. 22, an alternative belay device 20 includes an arm 112 pivotally coupled to belay frame 90 at hinge 114. Second pulley assembly 72 therefore moves along pulley path 74 so as to define an arc. A spring 116 gently biases the pulleys apart so as to draw in flexible member 18 as the climber climbs, while an off-the-shelf damper 118 resists movement of second pulley assembly 72 toward first pulley assembly 70 when the climber climbs, thereby providing an operation which is quite similar to that described above. Once again, the operation of the belay device is automatic, avoiding any need for a skilled attendant to supervise the belaying of the climber. Damper 118 may be any of a variety of off-the-shelf damping structures similar to those used as automobile shock absorbers. In some embodiments, a single gas/spring damper unit may replace both spring 116 and damper 118. Alternatively, hydraulic mechanism 80 might be replaced with a pneumatic system by using different seals, valves, orifice sizes, and the like. The operation of such a pneumatic belay device could remain substantially as described above, using a pressurized gas reservoir in place of fluid reservoir 82, all within the scope of the invention.

Figure 23:
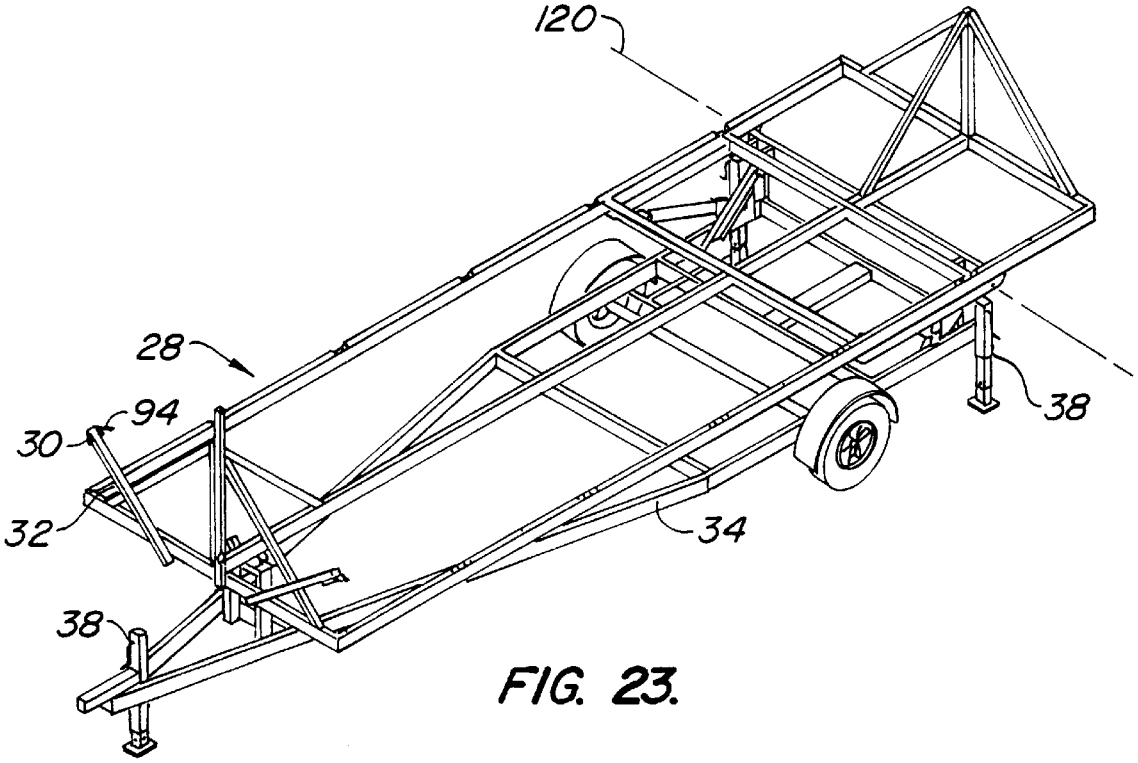
FIG. 23 is a perspective view of a trailer body and modular wall perimeter frame for use with the modular climbing tower of FIG. 1.
Figure 24:
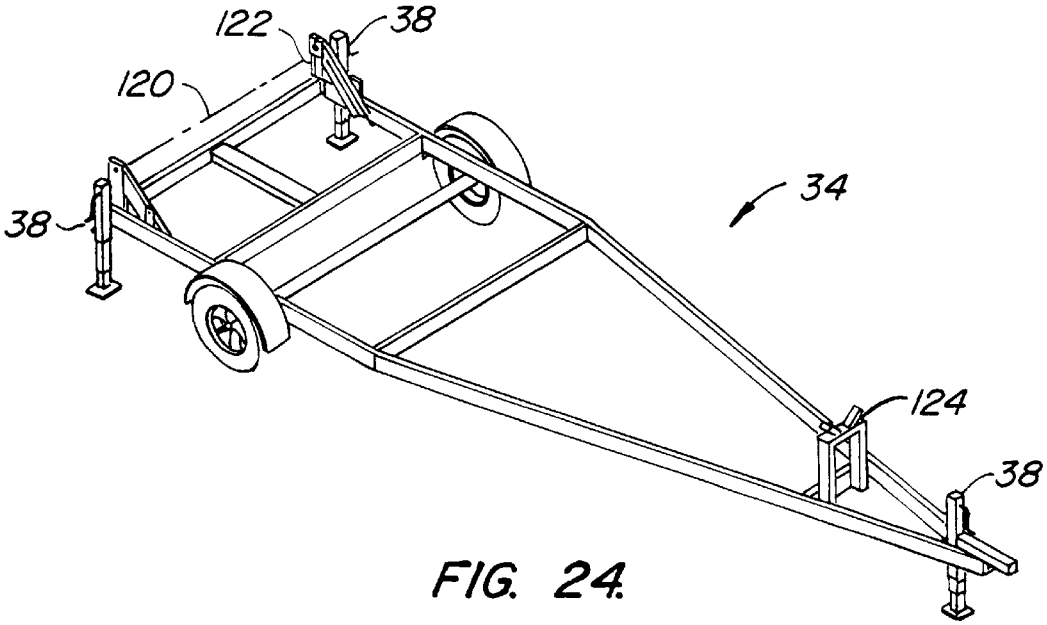
FIG. 24 is a perspective view of the trailer body of FIG. 23.
Figure 25:
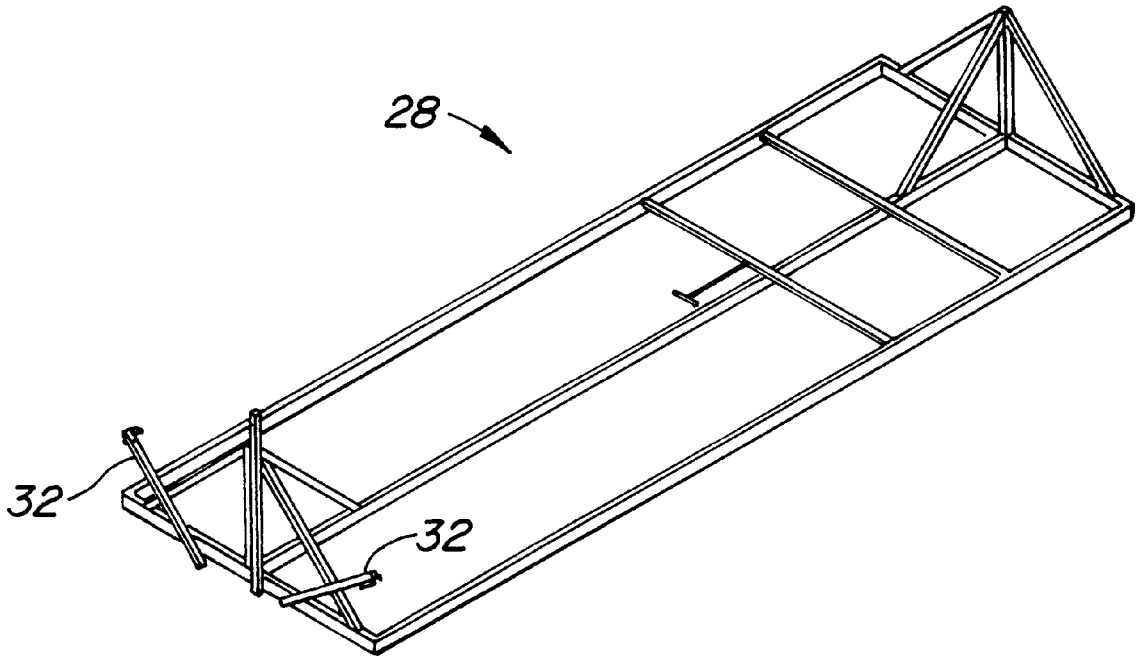
FIG. 25 is a perspective view of the perimeter frame for supporting the monocoque modular climbing wall of FIG. 1.

The structure of frame 28 and trailer 34 is seen most clearly in FIGS. 23–25. Frame 28 pivots about an axis 120 to allow tower 16 to move from a horizontal orientation (used for transporting the system) to a vertical assembly, as described above. Lift jacks 38 stabilize the climbing tower and allow it to withstand 60 mph winds and gusts of 80 mph when water ballast tanks on trailer 34 are filled and the unit is resting on level ground. Pivot truss 122 supports the pivotable hinge between trailer 34 and frame 28, while the frame includes upper and lower trusses to support davits 32 and the bottom of the monocoque tower assembly, as shown.

A variety of improvements may be made to simplify the operation and structure of the climbing system. Electrically powered jacks may speed up the set-up process, while an integral latch at any convenient frame/trailer support location 124 might be used to hold the tower in the horizontal position on the road.

Rather than using panel attachment structures welded to the frame as shown in FIGS. 23 and 25, cutting the lateral edges of the upper and lower flanges and attaching panels 42 along climbing surface 24 to frame 28 can reduce the number of parts used in the system, as can be understood with reference to FIG. 1A. Such attachment may be accomplished by drilling through the climbing surface 24 and into the lateral sides of frame 28, and then attaching the panels to the frame using self-tapping screws. It should be understood that such embodiments are facilitated where panels 42 do not include left and right flanges 52, 54, as frame 28 will directly support the lateral edges of the panel. The structure of trailer 34 can be simplified and lightened by using an independent suspension axle that acts as a structural cross-member.

In general, it is desirable to fabricate the tower lift and belay mechanisms as replaceable modules. The operation of these structures is preferably under the control of a modular master control panel, which may include further automated features. For example, a magnetic structure may be included in the belay device, optionally being mounted to the piston of the piston/cylinder assembly 84. By mounting a Hall effect transducer on the cylinder, the number of climbers can be electronically registered by counting the number of times the magnet passes the transducer. Such a counter can be fabricated using components similar to those often used in bicycle speedometers and the like. Electronic data from the register can be used for a variety of purposes, including accounting, maintenance, and replacement of worn parts, and the like.

While the exemplary embodiment has been described in some detail, by way of illustration and for clarity of understanding, a variety of modifications, changes, and adaptations will be obvious to those of skill in the art. Hence, the scope of the present invention is limited solely by the appended claims.

What is claimed is:

1. A modular artificial climbing structure comprising:

a trailer;

a plurality of rigid panels, each panel having upper and lower edges, the panel defining a lateral curve about an axis with a radially outwardly oriented climbing surface extending between the upper and lower edges, at least one of the lower edges affixed to the upper edge of an adjacent panel so that the climbing surfaces of the panels define a contiguous combined climbing area, the affixed panels axially aligned and defining a rigid tower having a top panel and a bottom panel, the tower pivotably mounted on the trailer so that the tower pivots from a road orientation to a climbing orientation, the tower in the road orientation having a first height and a total width which is less than a maximum trailer width, the tower in the climbing orientation extending upwardly from adjacent ground to the top panel at a climbing height greater than the first height;

a plurality of climbing holds distributed across the combined climbing area, the climbing holds defining at least three climbing routes, the routes sufficiently separated circumferentially along the lateral curves of the panels so that three climbers can climb the tower simultaneously; and a plurality of climber support devices affixed adjacent the top panel.

2. The climbing structure of claim 1, wherein each panel defines an axis, and wherein the panels are assembled coaxially to define a tower having a bottom panel, a top panel, and a plurality of the panels of the tower are affixed between the top panel and the bottom panel.

3. The climbing structure of claim 2, wherein the lateral curve extends over an arc of at least about 180 degrees.

4. The climbing structure of claim 3, wherein the combined climbing area is substantially cylindrical extending over an arc of more than about 120 degrees.

5. The climbing structure of claim 3, wherein the combined climbing area is substantially cylindrical extending over an arc of at least about 180 degrees.

6. The climbing structure of claim 1, wherein flanges radiate inwardly from at least some of the edges of the panels, the flanges formed integrally with the climbing surface, the flanges and the panels fully supporting the climbing holds as a monocoque structure between peripheral edges of the combined climbing area.

7. The climbing structure of claim 6, wherein the panels have lateral edges extending between the upper and lower edges, wherein the tower is affixed to a tower support frame by fastening the lateral edges of the panels to the tower support frame, wherein the tower support frame rotatably engages a trailer support frame of the trailer, and wherein the lateral edges extend from the climbing surfaces laterally beyond the tower support frame so that the tower support frame is disposed radially inwardly from the combined climbing surface.

8. The climbing structure of claim 1, further comprising an electro-hydraulic mechanism that moves the tower between the road orientation and the climbing orientation.

9. The climbing structure of claim 1, wherein the climber support devices comprise flexible members extending downwardly toward each climber, the flexible members coupled to auto-belay mechanisms, the auto-belay mechanisms freely drawing the flexible members.

10. The climbing structure of claim 1, wherein the panels have side edges extending between the upper and lower edges, and wherein the side edges of at least some of the panels are affixed to side edges of laterally adjacent panels.

11. The climbing structure of claim 1, wherein the tower is coupled to the trailer by a pivotal joint, the pivotal joint having a horizontal pivotal axis offset toward the top panel from the bottom edge of the bottom panel.

12. An artificial climbing structure comprising:

a trailer;

a rigid climbing tower pivotably mounted on the trailer, the tower having a climbing surface with upper and lower edges defining an axis, the climbing surface having a lateral curve about an axis and oriented radially outwardly, the tower having axial climbing height and a lateral width and pivotable between a road orientation and a climbing orientation, the axis of the tower in the road orientation extending horizontally along the trailer, the axis of the tower in the climbing orientation extending upwardly so that the lower edge is disposed adjacent ground and the upper edge is disposed at the climbing height from the ground, the width of the tower being less than a maximum trailer width;

a plurality of climbing holds distributed across the climbing surface, the climbing holds defining at least three axial climbing routes, the routes sufficiently separated circumferentially along the lateral curve of the tower so that three climbers can climb the tower simultaneously; and a plurality of climber support devices affixed adjacent the upper edge.

* * * * *